United States Patent [19]

Moyer

[11] 4,084,402

[45] Apr. 18, 1978

[54] TIMING CIRCUIT FOR DISPLAY SEQUENCING IN A DIGITAL WRISTWATCH

[75] Inventor: Norman E. Moyer, Newport Beach, Calif.

[73] Assignee: Hughes Aircraft Company, Culver City, Calif.

[21] Appl. No.: 579,998

[22] Filed: May 22, 1975

[51] Int. Cl.[2] ..... G04C 3/00; G04B 19/30

[52] U.S. Cl. ..... 58/23 R; 58/50 R

[58] Field of Search ..... 58/23 R, 50 R, 153; 340/324 R, 324 M, 336

[56] References Cited

U.S. PATENT DOCUMENTS

| | | | |
|---|---|---|---|
| 3,828,548 | 8/1974 | Martin | 58/50 R |
| 3,839,856 | 10/1974 | Dargent | 58/4 A |
| 3,854,277 | 12/1974 | Samejima | 58/50 R |
| 3,943,696 | 3/1976 | Portmann et al. | 58/23 R |

OTHER PUBLICATIONS

Robert Lyon-Caen, *Diodes, Transistors and Integrated Circuits for Switching Systems,* 1968, pp. 351–355.

*Primary Examiner*—Edith S. Jackmon
*Attorney, Agent, or Firm*—Fay I. Konzem; W. H. MacAllister

[57] ABSTRACT

A digital timing circuit in a digital watch with a two digit display. When said circuit is activated by a push button, the two display elements first display the hours information, next are blank for a short duration, then display the minutes information, then go blank until the button is pushed again.

6 Claims, 6 Drawing Figures

| DO | DH | Display |
|---|---|---|
| 0 | X | Blank |
| 1 | 1 | Hours |
| 1 | 0 | Minutes |

X = Don't Care

TIMING CIRCUIT FOR DISPLAY SEQUENCING IN A DIGITAL WRISTWATCH

BACKGROUND OF THE INVENTION

1. Field of the Invention

This invention relates to a digital timing circuit, and more particularly to a timing circuit in a digital wristwatch for displaying both the hours and minutes information sequentially by using a two digit display.

2. Description of the Prior Art

In the art, digital watches have used four display elements to display the horological information. Usually, two of the display elements display the hours and the other two display elements display the minutes; either liquid crystal or light emitting diode (LED) display elements have been used.

In order to construct a ladies' digital watch, the size of the watch and its electronics must be reduced considerably, as compared to the men's digital watch for aesthetic reasons. One of the major limiting factors in the size of the digital watch is that four display elements have been necessary to display the horological information. In the present invention, though, the width of the digital watch can be reduced to almost half that of the prior art digital watches because only two display elements instead of four display elements are used.

The digital timing circuit of the present invention allows a digital watch to be constructed, using only two display elements instead of the prior art four display elements, by displaying the time in a sequential manner, first the hours and then the minutes when said circuit is activated by a push button.

SUMMARY OF THE INVENTION

The digital timing circuit, in accordance with the invention, consists of four toggle flip-flops, a few additional logic gates and a push button for activating the timing sequence. With the push button and thereby the timing circuit unactivated, the two display elements in the digital watch are blank. But upon activating said button by depressing it, the timing sequence is begun, in which the display shows a first set of horological information, then the display is blank for a short duration and finally a second set of horological information is displayed and the display goes blank until activated again.

Accordingly, it is an object of this invention to provide a digital timing circuit, in a digital watch, which allows both the hours and the minutes to be displayed in a sequential manner on a two digit display.

Another object is to provide a digital timing circuit which allows the width of a digital watch to be reduced by approximately one-half.

It is a further object to provide a digital timing circuit which will provide a lower power consumption rate from the batteries of said digital watch. This lower power results because fewer digits are on for a shorter time, compared to prior art LED watches.

The features of the present invention which are believed to be novel are set forth with particularity in the appended claims. The present invention, both as to its organization and manner of operation, together with further objects and advantages thereof, may be better understood by reference to the following description, taken in conjunction with the accompanying drawings.

DETAILED DESCRIPTION

Figure 1:
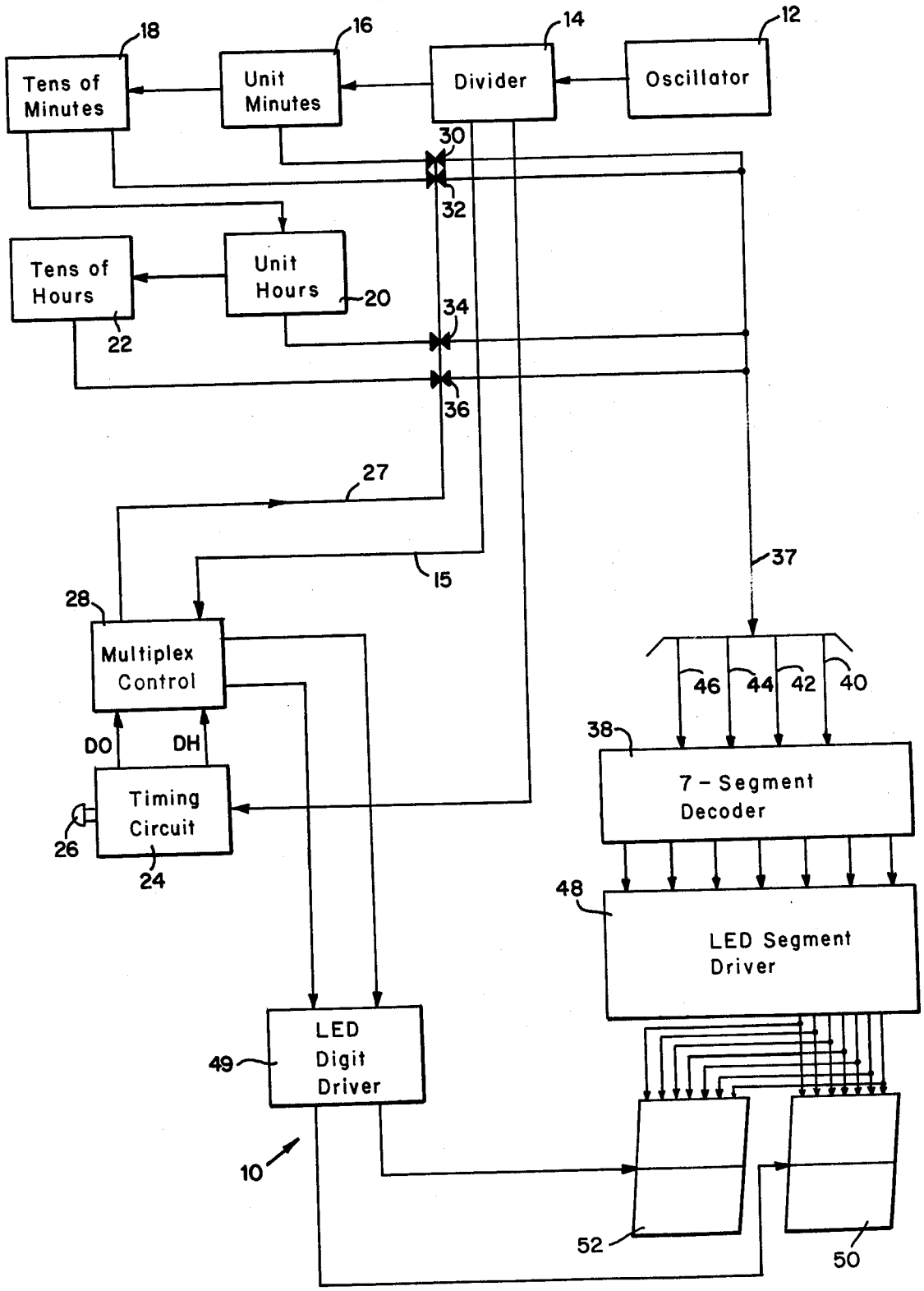
FIG. 1 is a block diagram of the circuitry of a digital watch incorporating the timing circuit of this invention.

Referring to FIG. 1, a block diagram of the electronic digital watch 10 includes an electronic oscillator 12, which is crystal-controlled to oscillate at a predetermined and substantially constant frequency. The output from the crystal-controlled oscillator 12 is driven into a CMOS divider 14 which results in a first output of one pulse per minute. The first output from A second output clock pulse is also delivered via line 15 to multiplex control 28. The first output from divider 14 is then driven into the unit minutes counter 16, which is a standard CMOS decade counter, which counts from 0 to 9. This unit minutes counter in turn drives the CMOS tens-of-minutes counter 18 which must count from 0 to 5 to satisfy the requirement of 60 minutes per hour. Similar to the unit minutes counter's operation, the tens-of-minutes counter 18 drives the unit hours counter 20, which is a decade counter. The unit hours counter 20 then drives the tens-of-hours counter 22, which counts from 0 to 1. Additional logic circuitry causes the hours counters to go from 12 to 1.

Seven-segment decoder 38 receives binary coded decimal (BCD) signals from the counters and outputs seven signals which correspond to the seven segments of the LED display devices so that, when turned on to be visibly distinctive, the segments represent the digit corresponding to the counter state. Since it is desired to display different horological information, it is necessary to switch different counters into the input of the seven-segment decoder. For simplicity, a single seven-segment decoder 38 is employed, and its inputs are multiplexed. There are four input lines 40, 42, 44, and 46 to the seven-segment decoder, each carrying one bit of the BCD information from the counters. Transmission gate sets 30, 32, 34, and 36 respectively connect BCD counters 16, 18, 20, and 22 to lines 40, 42, 44, and 46.

Normally, the display elements 50 and 52 are blank, until the digital timing circuit 24 of the present invention is activated by the depression of push button 26. Said timing circuit receives an input signal of 4 Hertz from the divider 14. Timing circuit 24 has two outputs, DO (Display On) and DH (Display Hours), both of which go to the multiplex control 28. When the binary level of DH is at a high level, the multiplex control 28 alternately opens transmission gate sets 34 and 36 and thus delivers the unit hours and tens-of-hours information to the seven-segment decoder 38 via line 37. Decoder 38 in turn receives the BCD signals from said counters and outputs seven signals which correspond to the seven segments of the LED display devices. The seven signals are then delivered to the LED segment driver 48 which finally enables display of said signals on both LED display elements 50 or 52. Multiplex control 28 also delivers signals to the LED digit driver 49 which causes the unit hours information to be displayed on display element 50 and the tens-of-hours information to be displayed on element 52. Additional circuitry causes a blank rather than a zero to be displayed in position 52 when tens-of-hours is zero.

When the DO output from timing circuit 24 is at a low binary level, the LED display elements are blank. This is accomplished by stopping the digit enabling signals 10, which are buffered signals from multiplex control 28.

Finally, when the DH output is at a low binary level, the multiplex control 28 alternately opens transmission gate sets 30 and 32 and allows the information from unit minutes counter 16 and tens-of-minutes counter 18 to be delivered to seven-segment decoder 38 which in turn delivers said information in the form of seven signals which correspond to the seven segments of the LED display to the LED segment driver 48. Multiplex control 28 also delivers signals to the LED digit driver 49 which causes the unit minutes information to be displayed on LED element 50 and the tens-of-minutes information to be displayed on LED display element 52.

Thus, when push button 26 is depressed, the timing circuit 24 controls that first the hour information is to be displayed on the LED's 50 and 52 for ½ second, the display is then blanked for ½ second, and then the minutes information is to be displayed on the LED's for ½ second, and finally the display is to go blank again.

The electronics of such a digital watch as shown in FIG. 1 is disclosed in detail in application Ser. No. 558,183 filed Mar. 13, 1975, entitled "Digital Watch with Liquid Crystal and Light Emitting Diode Displays," by E. C. Ho said patent application is assigned to the same assignee of the present invention. The subject matter of this cross-reference is hereby incorporated herein in its entirety.

Figure 2:
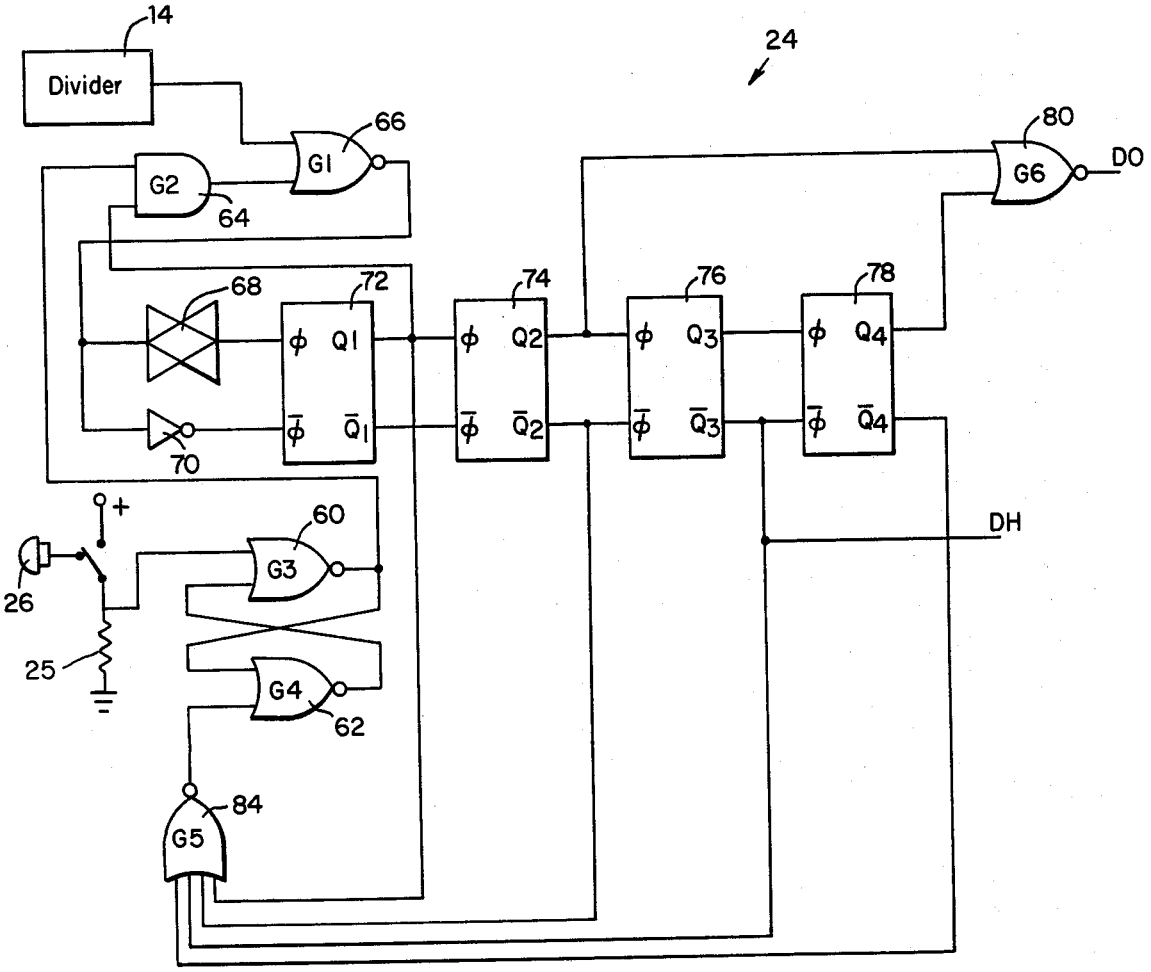
FIG. 2 is a logic diagram of the first embodiment of the digital timing circuit of the present invention.

Referring now to FIG. 2, the digital timing circuit 24 consists of push button 26 which is connected to a first input to NOR gate 60 and resistor 25. The second input to NOR gate 60 is connected to the output of NOR gate 62. The output of said gate 60 is connected to a first input to NOR gate 62 and to a first input to AND gate 64. The output from said AND gate is connected to a first input to NOR gate 66. In CMOS construction, AND gate 64 is actually part of NOR gate 66. The second input to NOR gate 66 is connected to a narrow negative 4 Hertz pulse from divider 14 of FIG. 1. More time is allowed to release the push button 26 if the 4 Hertz has a high duty cycle and switch bounce effects are eliminated. The output of NOR gate 66 is, in turn, connected to transmission gate 68 and to inverter gate 70, which form a two phase clock generator. The output of transmission gate 68 is connected to the clock input $\phi$ of toggle flip-flop 72. The output of inverter 70 is connected to the inverse clock input $\phi$ of toggle flip-flop 72. The Q1 output of flip-flop 72 is connected to a second input to AND gate 64 and to the $\phi$ input of toggle flip-flop 74. The Q1 output of flip-flop 72 is connected to the $\phi$ input to toggle flip-flop 74. Further, the Q2 output of flip-flop 74 is connected to the $\phi$ input of toggle flip-flop 76 and to a first input of NOR gate 80. The Q2 output of flip-flop 74 is connected to the $\phi$ input of toggle flip-flop 76. The Q3 output of flip-flop 76 is connected to the $\phi$ input of toggle flip-flop 78. The Q3 output of toggle flip-flop 76 is connected to the $\phi$ input of toggle flip-flop 78 and to the display hours (DH) output. The Q4 output of toggle flip-flop 78 is connected to a second input of NOR gate 80.

NOR gate 84 has four inputs, a first connected to the Q1 output of toggle flip-flop 72, a second input connected to the Q2 output of toggle flip-flop 74, a third input connected to the Q3 output to toggle flip-flop 76 and a fourth input connected to the Q4 output of flip-flop 78. The output of NOR gate 84 is connected to a second input of NOR gate 62.

THE OPERATION

Figures 3, 4:
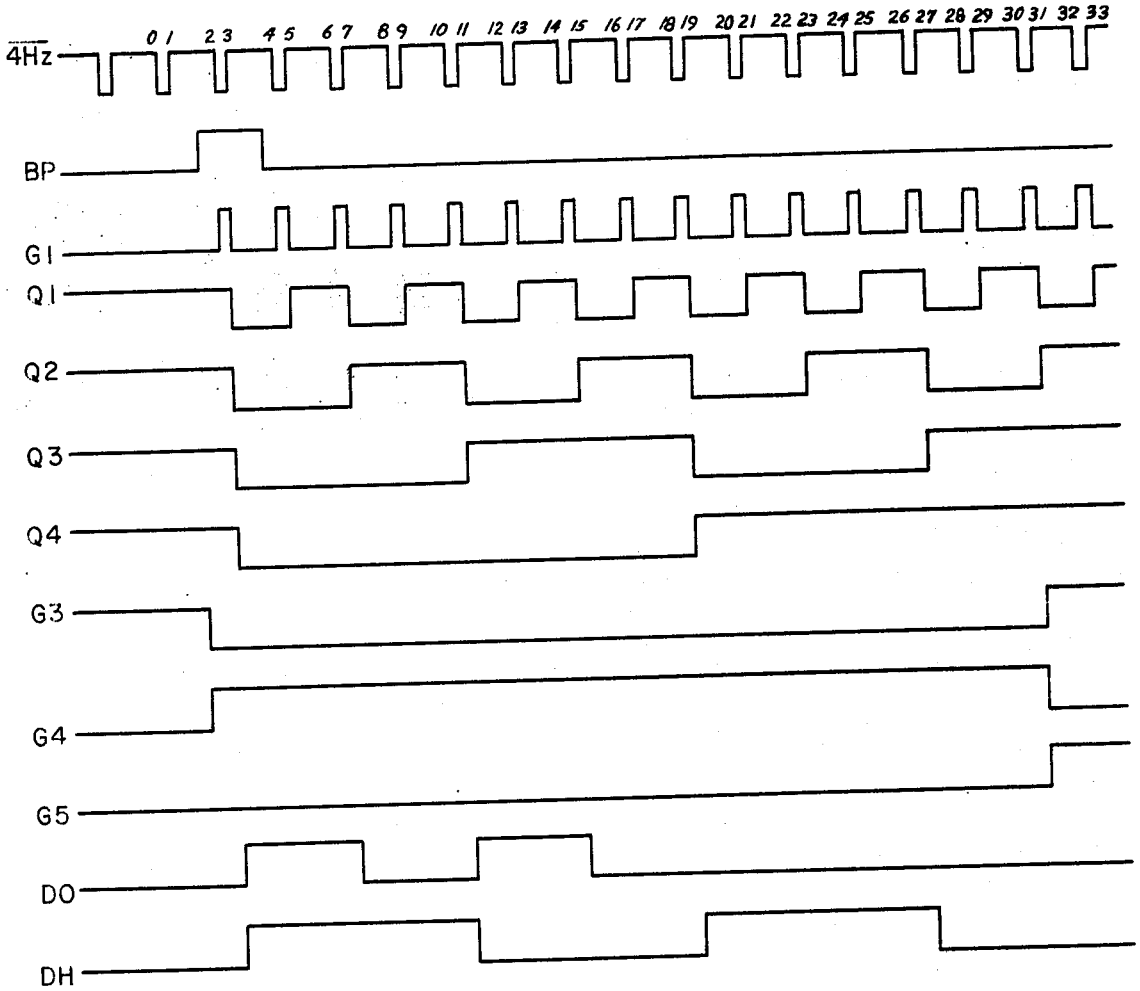
FIG. 3 is a timing diagram for the digital timing circuit of FIG. 2.
FIG. 4 is a truth table showing the necessary conditions to display hours and minutes.

FIG. 3 is a timing diagram for the digital timing circuit of FIG. 2. It is employed to show the operation of said circuit. The normal condition of timing circuit 24, with push button 26 unactivated is shown in FIG. 3, at time t0; the outputs of the four flip-flops Q1–Q4 and gate 60 are at a logic high binary level. Thus the negative 4 Hertz pulse is blocked by NOR gate 66 since the output of AND gate 64 is held at a binary high level, therefore nothing happens in the timing circuit until push button 26 is depressed.

When push button 26 is depressed at time *t*1, the push button input to NOR gate 60 goes to a binary high level, the output of NOR gate 60 changes states to a logic low level, which in turn causes the output of NOR gate 62 to go high. Since an input to AND gate 64 is now a low logic level, the output from said gate is at a low level. Since the output from AND gate 64 is an input to NOR gate 66, when the negative 4 Hertz pulse, which is the second input to NOR gate 66, goes low at time *t*2, the output from NOR gate 66 will go high.

The output of NOR gate 66 will stay high until its input from the negative 4 Hertz pulse goes high again at time *t*3. When the output from NOR gate 66 goes low at time *t*3, the output Q1 of flip-flop 72 will also go low, as well as the output Q2, Q3, and Q4 from flip-flops 74, 76, and 78, respectively. At time *t*3, the Q2 output of flip-flop 74, which is an input to NOR gate 80, is at a low logic level and said NOR gate's other input, the Q4 output of flip-flop 78, is also at a low logic level; therefore, the output from NOR gate 80, DO is a high level, as shown in FIG. 3. Also, the DH output is at a high level at time *t*3. Since the DO and DH outputs are high from time *t*3 to time *t*7, the hours are displayed for ½ second on the two LED display elements.

At time *t*4, on the next falling edge of the 4 Hertz pulse, the output from NOR gate 66 will again go to a high logic level. At time *t*5, which is on the rising edge of the 4 Hertz pulse, the output from NOR gate 66 will go low, causing the output Q1 from flip-flop 72 to go high. At time *t*6, the output of NOR gate 66 will again go high. At time *t*7, the output of NOR gate 66 again will go low, causing the output Q1 from flip-flop 72 also to go low and causing the output Q2 from flip-flop 74 to go high. Finally, at time *t*7, the output of NOR gate 80, DO will go low, since the Q2 input to NOR gate 80 is at a high level.

The truth table of FIG. 4 shows the prerequisite conditions for displaying hours and minutes. When both the DO and the DH outputs are at a high binary level, the hours are displayed, as can be seen in FIG. 3 between the time *t*3 and the time *t*7. Then, between time *t*7 and time *t*11, the DO output is low, thereby causing the display to be blank. Finally, between time *t*11 and time *t*15 the DO output is high and the DH output is low, causing the minutes information to be displayed.

At time *t*9 when the output of NOR gate 66 goes low, the Q1 output of flip-flop 72 goes high until the next falling edge from NOR gate 66, which occurs at time *t*11. At time *t*11, the Q2 output from flip-flop 74 goes low and the Q3 output from flip-flop 76 goes high. Also at time *t*11, the Q2 input to NOR gate 80 is low and the Q4 input to NOR gate 80 is also low; therefore, the output of NOR gate 80 goes to a high logic level. As can be seen from the truth table of FIG. 4, the minutes information will be displayed when the DO output is high and the DH output is low; this condition exists between time *t*11 and time *t*15, as shown in the timing diagram of FIG. 3.

At time *t*15, the Q2 input to gate 80 is at a high logic level and the DO output goes low. As can be seen from the truth table of FIG. 4, when the DO output is low the display will be blank.

Finally, when the Q1, Q2, Q3 and Q4 inputs to NOR gate 84 are at a low level, *t*31, the output of gate 84 will go high, thereby causing the cross-coupled NOR gates 60 and 62 to flip back to the state before the button was pushed. Then at *t*33, the output $Q_1$ of flip-flop 72 goes high, the output of AND gate 64 goes high, and the clock into NOR gate 66 is blocked. The circuit sits in this state until the button is pushed again.

Figure 5:
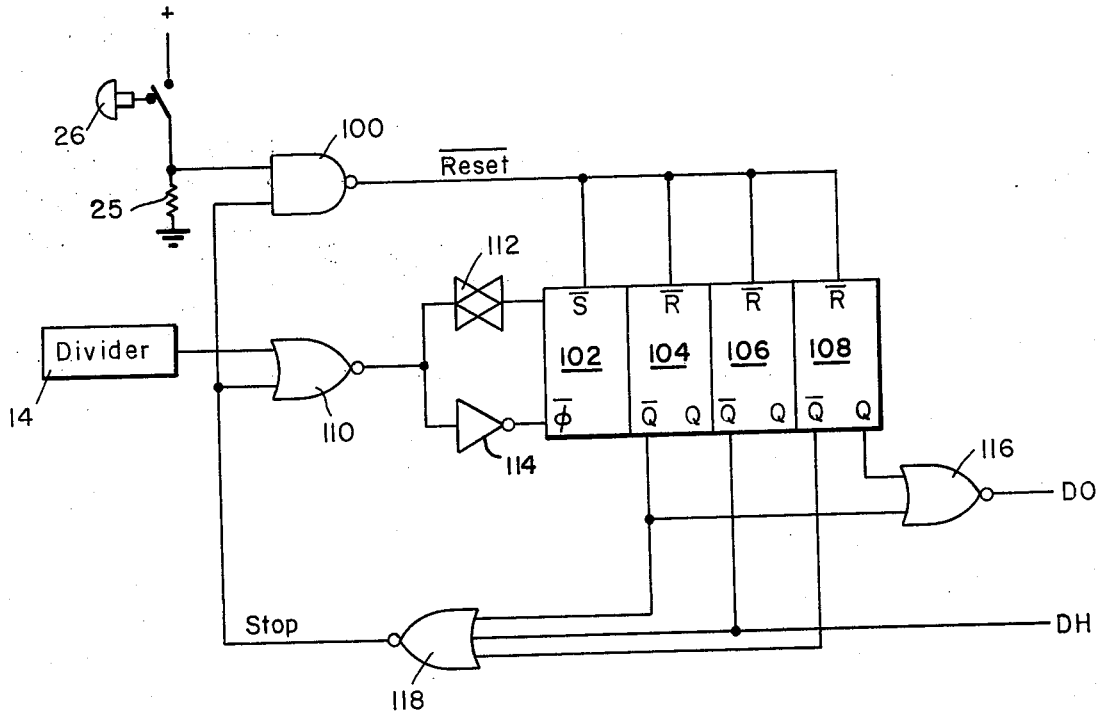
FIG. 5 is a logic diagram of the second embodiment of the digital timing circuit of the present invention.

FIG. 5 shows a second embodiment to the timing circuit of the present invention. Push button 26 is connected to a first input to NAND gate 100 and to resistor 25. The output of NAND gate 100 is connected to the set of flip-flop 102, to the reset of flip-flops 104, 106, and 108. The Q output of flip-flop 104 is connected to a first input to NOR gate 116 and to a first input to NOR gate 118. The Q output of flip-flop 106 is connected to the display hours (DH) output and to a second input to NOR gate 118. The Q output of flip-flop 108 is connected to a third input to NOR gate 118. And the Q output of flip-flop 108 is connected to a second input to NOR gate 116. Finally, the output of NOR gate 116 is the display on output (DO).

The output of NOR gate 118 is connected to a first input to NOR gate 110 and to a second input to NAND gate 100. The second input to NOR gate 110 is connected to a 4 Hz narrow negative pulse from the divider 14. And the output of NOR gate 110 is connected through transmission gate 112 to clock input $\phi$ of flip-flop 102 and through inverter 114 to the inverse clock input $\phi$ of flip-flop 102. The rest of the flip-flops are clocked by the Q and Q of the preceding flip-flop, forming a ripple counter.

Figure 6:
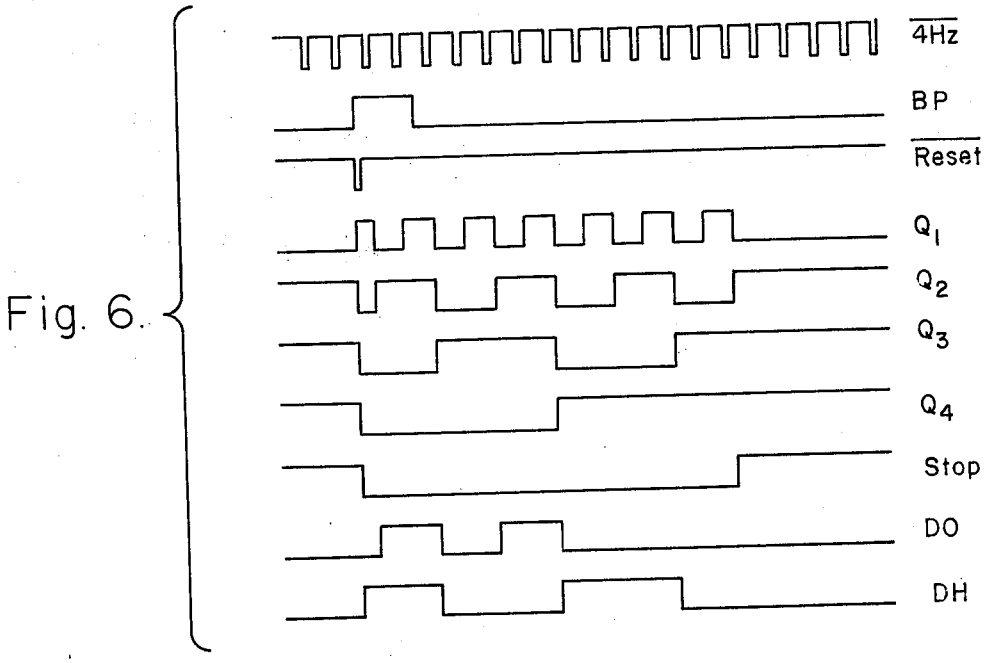
FIG. 6 is a timing diagram for the digital timing circuit of FIG. 5.

FIG. 6 is a timing diagram for the digital timing circuit of FIG. 5. When push button 26 is unactivated, the reset is at a high binary level and the Q outputs of flip-flops 102, 106, and 108 are at a high binary level, therefore, the DO output is also at a low binary level and no horological information is displayed on LED display elements 50 and 52 of FIG. 1. When push button 26 is depressed or activated, the output of NAND gate 100 goes to a low binary level, thereby resetting flip-flops 104, 106, and 108 to a low binary level, and setting flip-flop 102 to a high level. Therefore, the output of NOR gate 118 goes low to stop the resetting of the flip-flops and to allow the counter composed of said flip-flops to run. This counter, composed of flip-flops 102, 104, 106, and 108, counts in the same manner as described previously with reference to FIGS. 2 and 3. That is, it is an up counter that makes transitions on the negative-going edge of the clock input.

When the last or stop state is reached when the Q outputs of the last three flip-flops go to a low binary level, the output of NOR gate 118 goes to a high binary level. NOR gate 110 then outputs a low binary level signal and doesn't transmit the incoming clock, which stops the counter when there is a low binary level signal on output DO, turning off the LED display elements.

The only operational difference between the two embodiments described here is the length of time between successive sequences, or otherwise stated, how long the button can be held down without starting another display sequence. For the circuit of FIG. 3, one can push the button down 2¼ seconds after the sequence stops, and for the circuit of FIG. 5, only 1½ seconds are available. Both embodiments are unaffected by switch bounce during "make" or "break" and use the simplest switch available a single pole, single throw (SPST) unit.

Although the device which has just been described appears to afford the greatest advantages for implementing the invention, it will be understood that various modifications can be made thereto without going beyond the scope of the invention, it being possible to replace certain elements by other elements capable of fulfilling the same technical functions therein.

What is claimed is:

1. A digital timing circuit in a digital watch with two electro-optical display elements, when said circuit is activated by a manually operable switch, the timing sequence begins and said display elements display a first set of horological information, then said display elements are blank for a short duration, and finally display a second set of horological information and are then blank again, comprising:

a clock pulse source;

first gate means having first and second input connections and an output connection;

said first input of said first gate connected to said clock pulse source;

second gate means having first and second input connections and an output connection;

said second input of said first gate connected to said output of said second gate;

third gate means having first and second input connections and an output connection;

fourth gate means having first and second input connections and an output connection;

said output of said third gate connected to said first input of said second gate and to said first input of said fourth gate;

said output of said fourth gate connected to said input of said third gate;

a manually operable switch for activating said digital timing circuitry, said switch connected to said first input to said third gate;

fifth gate means having first, second, third, and fourth input connections and an output connection;

first flip-flop having first and second input connections and first and second output connections;

second flip-flop having first and second input connections and first and second output connections;

third flip-flop having first and second input connections and first and second output connections;

fourth flip-flop having first and second input connections and first and second output connections;

two phase clock generating means having an input connection connected to said output of said first gate means and having a first output connected to said first input of said first flip-flop and a second output connected to said second input of said first flip-flop;

said first output of said first flip-flop connected to said first input of said second flip-flop, to said second input to said second gate and to said first input to said fifth gate;

said second output of said first flip-flop connected to said second input of said second flip-flop;

sixth gate means having first and second input connections and an output connection;

said first output of said second flip-flop connected to said first input of said third flip-flop and to said first input of said sixth gate;

said second output of said second flip-flop connected to said second input of said third flip-flop, and to said second input of said fifth gate;

said second output from said third flip-flop connected to said third input to said fifth gate and to said second input of said fourth gate for forcing said flip-flop into a known state;

said first output of said third flip-flop connected to said first input of said fourth flip-flop;

said second output of said third flip-flop connected to said second input of said fourth flip-flop;

said first output of said fourth flip-flop connected to said second input of said sixth gate;

said second output of said fourth flip-flop connected to said fourth input of said fifth gate;

first and second electro-optical display elements which display the digits of first and second sets of horological information;

said output of said sixth gate being connected to said first electro-optical display elements;

said second output of said third flip-flop being connected to said second electro-optical display elements;

said second set of horological information is displayed on said electro-optical display elements when said output of said sixth gate is at a logical binary high level and said second output of said third flip-flop is at a logical binary low level; and said first set of horological information is displayed on said electro optical display elements when said outputs of said sixth gate and said second output of said third flip-flop are at a logical binary high level.

2. The digital timing circuit as recited in claim 1, wherein said second gate is an AND gate.

3. The digital timing circuit as recited in claim 1, wherein said first, third, fourth, fifth, and sixth gates are NOR gates.

4. A digital timing circuit in a digital watch with two electro-optical display elements, when said circuit is activated by a manually operable switch the timing sequency begins and said display elements display a first set of horological information, then said display elements are blank for a short duration, and finally display a second set of horological information and are then blank again, comprising;

a clock pulse source;

first gate means having first and second input connections and an output connection;

said first input of said first gate connected to said clock pulse source;

second gate means having first and second input connections and an output connection;

said second input of said first gate connected to said first input to said second gate;

third gate means having first, second and third input connections and an output connection;

fourth gate means having first and second input connections and an output connection;

said output of said third gate connected to said first input of said second gate and to said second input of said first gate;

a manually operable switch for activating said digital timing circuitry, said switch connected to said second input to said second gate;

first flip-flop having first and second input connections and first and second output connections;

second flip-flop having first and second input connections and first and second output connections;

third flip-flop having first and second input connections and first and second output connections;

fourth flip-flop having first and second input connections and first and second output connections;

two phase clock generating means having an input connection connected to said output of said first gate means and having a first output connected to said first input of said first flip-flop and a second output connected to said second input of said first flip-flop;

said first output of said first flip-flop connected to said first input of said second flip-flop;

said second output of said first flip-flop connected to said second input of said second flip-flop;

said second output of said second flip-flop connected to said first input of said third gate and to said second input of said fourth gate;

said second output of said third flip-flop connected to said second input of said fourth flip-flop and to said second input to said third gate;

said first output of said fourth flip-flop connected to said first input of said fourth gate;

said second output of said fourth flip-flop connected to said third input of said third gate;

first and second electro-optical display elements which display the digits of first and second sets of horological information;

said output of said sixth gate being connected to said first electro-optical display element;

said second output of said third flip-flop being connected and said second electro-optical display element;

said second set of horological information is displayed on said electro-optical display when said output of said fourth gate is at a logical binary high level and said second output of said third flip-flop is a a logical binary low level; and said first set of horological information is displayed on said electro-optical display when said outputs of said fourth gate and said second output of said third flip-flop are at a logical binary high level.

5. The digital timing circuit as recited in claim 4, wherein said second gate is an AND gate.

6. The digital timing circuit as recited in claim 4, wherein said first, third, and fourth gates are NOR gates.

* * * * *